United States Patent [19]

Guenther et al.

[11] 3,995,408

[45] Dec. 7, 1976

[54] PROCESS AND APPARATUS FOR FILLING FOLDABLE OR RIGID PACKAGES

[75] Inventors: Wolfgang Guenther; Gunter Thielen, both of Ludwigshafen; Hans Hackner, Gernsheim; Friedrich Ferdinand Hauptstein, Krefeld-Traar, all of Germany

[73] Assignee: BASF Aktiengesellschaft, Ludwigshafen (Rhine), Germany

[22] Filed: Sept. 30, 1975

[21] Appl. No.: 618,043

[52] U.S. Cl. ..... 53/126; 53/187; 53/371; 141/10; 141/114; 141/315

[51] Int. Cl.[2] ..... B65B 1/22; B65B 7/06

[58] Field of Search ..... 53/126, 124 R, 35, 37, 53/266, 235, 187, 188, 191, 371; 141/10, 68, 114, 313, 314, 315, 316, 317

[56] References Cited

UNITED STATES PATENTS

| | | | |
|---|---|---|---|
| 1,747,312 | 2/1930 | Middelboe | 141/315 X |
| 1,816,587 | 7/1931 | Johns | 141/315 X |
| 2,500,768 | 3/1950 | Peterson | 141/315 X |
| 3,199,550 | 8/1965 | Crowe | 141/315 X |
| 3,474,836 | 10/1969 | Schwake et al. | 141/315 X |

*Primary Examiner*—Travis S. McGehee
*Assistant Examiner*—Horace M. Culver
*Attorney, Agent, or Firm*—Johnston, Keil, Thompson & Shurtleff

[57] ABSTRACT

A process and associated apparatus for filling packages with free-flowing solids through spouts, in which some of the material is initially fed to the package with the latter in its gravity position, the position of the package is changed once or a number of times with shaking of the entire package, and finally the remainder of the material is filled into the package with the latter in its gravity position.

4 Claims, 2 Drawing Figures

PROCESS AND APPARATUS FOR FILLING FOLDABLE OR RIGID PACKAGES

This invention relates to filling foldable or rigid packages with intermittent shaking of the container, particularly for filling valve sacks, using apparatus having filling and settling means, in which process a predetermined amount of a free-flowing material can be filled into a package making optimum use of the capacity thereof.

Processes and apparatus for filling valve bags and similar containers are known in which the container is placed vertically on a platform and is vibrated continuously or intermittently during filling to settle the material filled (German Pat. No. 852,673 with Addition 936,255). The up-and-down movements of the container are effected by means of a motor at a relatively high amplitude and low frequency. No other change in position of the container during filling takes place with such vertical vibrating movements, with the result that if the spout is disposed asymmetrically in relation to the sack a portion of the sack remains unfilled on account of the cone formed by the flowing material. According to said reference, it is possible to apply blows to the sides of the sack suspended under the spout, in a known manner, instead of vibrating the sack by vertical reciprocation of the platform. German Published Application No. 1,761,727 describes a similar vibrator in which the container is placed on a horizontal support which can be intermittently vibrated horizontally by means of a motor-driven eccentric at a frequency which is slightly greater than one up-and-down movement.

German Published Application No. 1,226,479 describes a sack-filling machine in which controlled vertical blows are automatically applied to the sack, which vertical blows are applied by a roller and are transmitted by the flexible base of the container. This roller applies its movement to the container vertically through the center of gravity thereof and raises it considerably from its original position. No other change in position of the container takes place during filling to relieve the load on the upper portions of the sack.

In other known valve bag filling machines the sack support changes its position virtually continuously during filling. The sack support is inclined to the horizontal both at the start and at the end of the filling operation (German Published Application No. 2,211,968). This filling apparatus does not take into consideration the most suitable position of the sack for any vibration which may have to be carried out, and the same applies to the requirement of optimum utilization of the capacity.

Finally, German Published Application No. 2,207,626 describes a sack-holding device equipped with a chute and used in conjunction with a valve sack filling machine, in which system the material passed to the sack fitted to said device is shaken and settled during filling by means of a ram applying blows to the top end of the sack, which ram emerges from the surface of a sack support formed by two articulately interconnected parts of the chute. Since the major portion of said sack support does not take part in said vibrating movements and the position of the sack is retained throughout the filling operation, the said movements cannot settle all the material passed into the sack.

It is an object of the present invention to provide apparatus in which rigid or foldable containers including valve bags having volumes or dimensions of minimum size for a given amount of material to be contained therein are filled with said material in optimum manner and in a minimum period of time with intermittent vibration.

A specific object is to avoid the normally inevitable dead space which occurs near an asymmetrically disposed filling opening of the container. The process and associated apparatus should also be such as to permit secure closing of the valve of a valve bag after the latter has been filled, which closing should be possible without the use of adhesives and, in particular, should be automatically effected by the application of pressure.

According to the present invention the above objects are achieved by a. filling the container in known manner with material, to an extent of 20 to 80% and preferably from 40 to 60%, by volume, with the container, e.g., a bag, suspended from the spout and hanging in the position induced by gravity on the container and its content of said material, b. displacing the container once or several times to an inclined position, in which the center of gravity of the material contained therein is not in line with a perpendicular line passing through the mouth of the spout, and continuing filling in this position with vibration of the material in the container and, finally, c. terminating the filling operation in the position of center of gravity of the material in the container.

During the change of position as described under (b) above, the filling operation may be effected intermittently.

An apparatus for carrying out the above process is characterized, according to the invention, by a shift lever system coupled to a vibrator and equivalent to a partially offset two-armed lever which one arm receives the vibrations and the other effects shifting of the container whilst simultaneously transmitting the said vibrations thereto. According to another feature of the invention, when the apparatus is used for filling valve bags one arm of the shift lever system projects into the path of release or path of slide of the filled sack and closes the sack valve by stroking down.

Other features of the invention will be evident from the following description with reference to the accompanying drawings.

Figure 2:
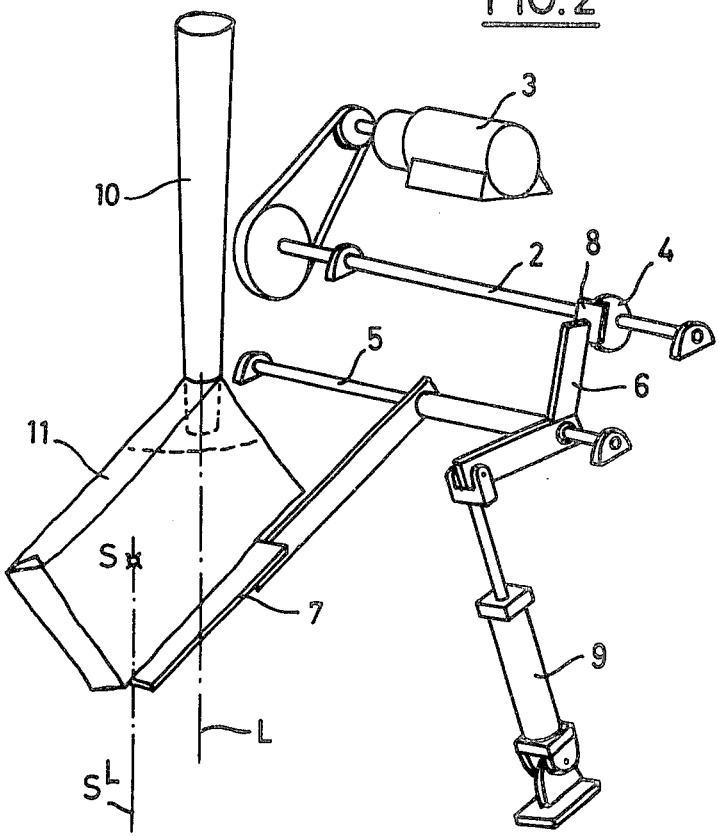
FIG. 2 illustrates the changed position of the container and the active position of the shift lever system transmitting the vibratory movements and shows diagrammatically the special arrangement of apparatus according to the invention when used in conjunction with a weighing machine. However, the process and apparatus may be used on any filling equipment without weighing of the material.

In the upper half of, say, a weighing machine housing 1 there is mounted a horizontal shaft 2 driven by a motor 3. To the shaft 2 there is attached a vibrator taking the form of an out-of-balance member 4, e.g. an eccentric. Below the shaft 2 and parallel thereto there is provided another horizontally mounted shaft 5 to which an essentially vertical, crank-shaped, i.e. offset, shift lever system 6 is rigidly mounted. Advantageously, the lever system 6 is adjustably connected to the shaft 5. The lower, free end of the said lever system 6 carries a plate 7 which is capable of being pressed against the rigid or foldable, yielding side of the container 11 in order to apply the vibratory movements thereto and for changing its position temporarily, which plate also temporarily bears the major portion of the weight of the container and the material contained therein. The top end of the shift lever system 6 is connected to a plate or elastic support 8 which is designed to rest against the eccentric 4 when the mechanism comprising parts 2 to 9 is activated so as to transmit the vibrations to the container (see FIG. 2). The shaft 5 and lever system 6 mounted thereon may be pivoted by a hydraulic or pneumatic cylinder 9 which may be actuated either automatically or arbitrarily during the filling operation.

Where the apparatus is to be used for filling, say, rigid packages, such as drums, the panel 7 on the lower lever of the shift lever system 7 is conveniently trough-shaped and has a projecting edge at the bottom to prevent the rigid drum from slipping off when being filled.

When filling foldable packages, particularly valve bags, which leave the filling apparatus down a discharge chute 12 when filled, the special relationship of the shift lever system 6 to the discharge chute is such that the panel 7 is located in the downward path of movement of the container 11 at a specific distance therefrom and then again presses against the container to close its valve.

Figure 1:
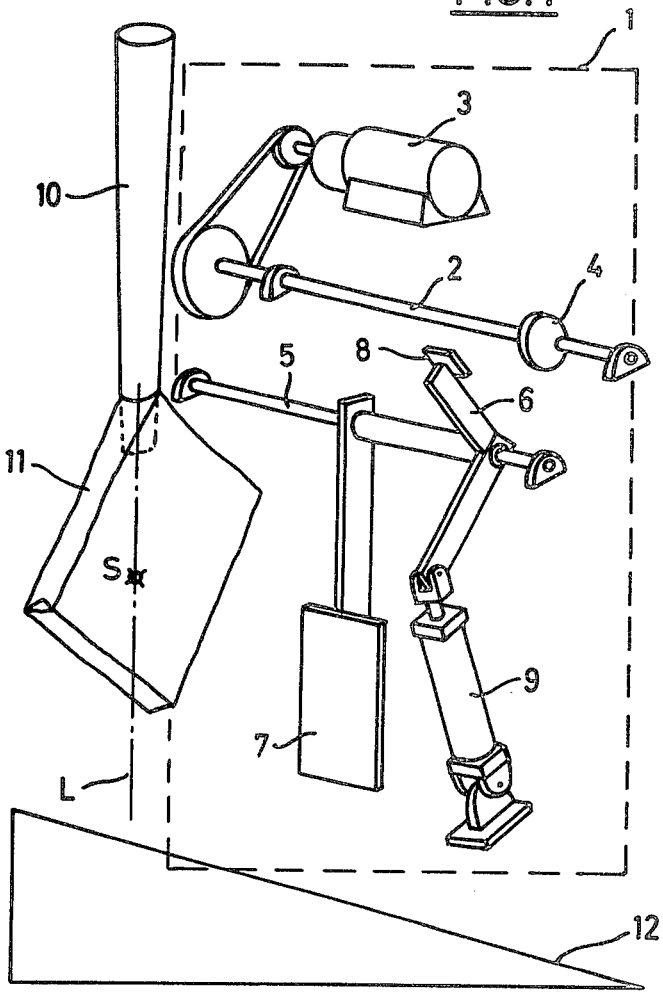
FIG. 1 shows the package suspended from a spout in its position of center of gravity and the shift lever system which is inactive in this position.

The entire filling operation thus takes place as follows:

The container 11 is clipped to the spout 10 and is partially filled in its gravity position as illustrated in FIG. 1. It has been found that about half of the required amount of material can be fed to the container at this stage provided the material is not one having particularly poor flowing properties. Accordingly, the amount of material fed in this first stage, apart from specific materials, is from about 20 to 80% and preferably from 40 to 60%, by volume. On completion of this stage, the panel 7 of the shift lever system is caused to move against the container 11 by the cylinder 9 and then to lift the container such that its assumed longitudinal axis is shifted to an almost horizontal position, the material being simultaneously vibrated and thus settled so as to cause the cone of material below the spout 10 to spread out (see FIG. 2). In extreme cases, i.e. when the material being filled has poor flowing properties, the shift lever system may be caused, either automatically or arbitrarily, to shift the position of the container 11 a number of times. The lever system 6 is then returned to its inoperative position as shown in FIG. 1, in which case the container 11 is again in its position of center of gravity and the surface of the material in the container again shows a certain change of position. In this position, the remainder of the material may be fed into the container without difficulty so that only an insignificant air space remains in the container when full and the container has a minimum volume for the desired amount of material to be contained therein. It is possible to effect a further partial swing of the lever system 6 in the final phase of filling in order to shake the container for a further brief period during this phase without changing the position of the container 11 from its gravity position to any significant extent. The shift lever system 6 with its panel 7 is then swung back until it enters the path of slide of, say, a valve bag which, after filling, is discharged down the aforementioned stationary or tiltable chute 12. The plate then closes the valve of the sack by a stroking movement.

Thus the apparatus effects optimum filling of rigid or foldable containers by carrying out the following steps in succession:

1. lifting the container once or a number of times from its gravity position to an inclined to horizontal position,
2. transmitting vibrations extending over larger or smaller parts of the wall of the container depending on the size of the panel 7, which vibrations may be repeated as desired with a change of position at each repetition,
3. closing the valve when the filled sack is discharged from the equipment.

We claim:

1. Apparatus for filling a container supported under a spout with flowable solids supplied from the spout and comprising a shaft, piston-cylinder means connected to said shaft for turning said shaft, a container support member mounted on said shaft for pivotal movement when said shaft is rotated, said member being pivotable between a first, rest position without contacting the container and a second, container-supporting position wherein, in the latter position, the container under said spout has one side resting on said member and the container thereby is tilted from its normal filling position, vibration-inducing means adjacent said shaft, and contact means on said shaft movable into contact with said vibrating means when said support member is in the container-supporting position whereby vibrations of said vibration-inducing means are transmitted via said shaft and said support member to said container and its content of said flowable solids.

2. Apparatus as claimed in claim 1 wherein said container is a valve bag having a closable opening, said bag being hung beneath said spout with said spout in said opening, and said support member, when in the container-supporting position, tilting said bag from its normal hanging position.

3. Apparatus as claimed in claim 1 wherein said vibration-inducing means comprises a motor, a shaft rotatably driven thereby and an eccentric member mounted on and rotatable with said shaft, and said contact means being movable into contact with said eccentric member.

4. Apparatus as claimed in claim 1 wherein said container is a valve bag having a closable opening, said bag being hung beneath said spout with said spout in said opening, and said support member, when in the container-supporting position, tilting said bag from its normal hanging position, and means for moving filled bags from beneath said spout along a path wherein the closable opening of each bag lies in the pivotal movement path of said support member whereby the latter also is pivotable by said shaft against said opening to effect closure thereof.

* * * * *